US006669502B1

(12) United States Patent
Bernhart et al.

(10) Patent No.: US 6,669,502 B1
(45) Date of Patent: Dec. 30, 2003

(54) HIGH-SPEED AXIAL CONNECTOR

(75) Inventors: William H. Bernhart, Mount Joy, PA (US); Brent D. Yohn, Newport, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/247,097

(22) Filed: Sep. 19, 2002

(51) Int. Cl.[7] ..... H01R 13/58
(52) U.S. Cl. ..... 439/460; 439/610
(58) Field of Search ..... 439/460, 733.1, 439/736, 610, 650, 750, 462, 598

(56) References Cited

U.S. PATENT DOCUMENTS 2,404,682 A * 7/1946 Baker ..... 439/263
3,611,273 A * 10/1971 Alibert ..... 439/374
4,214,802 A * 7/1980 Otani et al. ..... 439/275
5,567,174 A * 10/1996 Ericson et al. ..... 439/462
5,755,589 A * 5/1998 Koch ..... 439/427

* cited by examiner

*Primary Examiner*—Lynn Feild

(57) ABSTRACT

An electrical connector is provided for connection to a high speed cable, such as of quad cable construction. The connector includes a tubular outer shell having a cavity formed therethrough that extends between loading and mating ends of the shell. A unitary dielectric member is inserted into the cavity and provided with a plurality of contact passages formed therethrough, each of which receives a rear loaded contact. The dielectric member includes a flared section having collets about the perimeter of the dielectric material and extending along a portion of the length of the dielectric material. The collets permit the flared section to collapse onto the contact passages to positively and firmly grip the contacts inserted within the contact passages. The unitary dielectric member affords an easily manufactured connector that maintains the contacts and wires within a predefined geometry with respect to the axis of the connector and at a predefined position along the length of the connector.

20 Claims, 10 Drawing Sheets

HIGH-SPEED AXIAL CONNECTOR

BACKGROUND OF THE INVENTION

The present invention generally relates to an axial connector for positioning and retaining wires and contacts in a fixed position.

Coaxial connectors have been proposed that are mountable to the ends of lines in a cable, such as one that carries one or more differential signals. For instance, quad cables are used for conveying high-speed data communications. The quad cables include one pair of transmit lines and one pair of receive lines, all of which are twisted in a helix to maintain a desired orientation with respect to one another. When a connector is attached to a quad cable, it is preferable to maintain the transmit and receive lines in a fixed geometry. The transmit and receive lines are connected to transmit and receive contacts which are located in a particular relation to one another within the connector. In the event that the spacing between, or overall geometry of, the transmit and receive lines and/or contacts is disturbed from a preferred configuration, particular receive and/or transmit lines begin to interact with one another in a detrimental manner. For example, such detrimental electromagnetic interaction may cause degradation in the signal-to-noise ratio, impedance and the like.

One conventional quad connector includes a tubular shell having a hollow core configured to receive a two-piece dielectric material that hold contacts connected to lines of the quad cable. The two-piece dielectric included a rear dielectric segment stacked end-to-end with a lead guide dielectric segment, where each segment is molded separately. The lead guide segment included a group of holes therethrough arranged in a pattern in which the contacts are held. Lead portions of each contact are loaded through the back end of the guide segment. Once loaded into the guide segment, the contacts have rear portions extending from the back end of the guide segment.

The rear dielectric segment of the two-piece dielectric is side loaded onto the rear portions of the contacts that extend from the guide segment. The rear dielectric segment is tubular in shape and includes two slots cut in the side thereof, with the slots being separated by an insulated interior wall. Rear portions of the contacts were side loaded into the slots in the split section. The slots extend along the length of the rear dielectric segment. The rear portions of the contacts are formed with a ribbed or raised peripheral segment surrounding the main body of each contact. The main body of each contact is formed with a first diameter, while the raised portion is formed with a larger second diameter. The slots cut in the split dielectric segment are notched to define a stepwise slot width having ledges dimensioned to interlock with the raised portion of each contact.

The interlocking relation formed between the slots and the raised portions of the contacts resists longitudinal movement of the contacts along the length of the rear split dielectric segment. The split dielectric segment abuts against the rear end of the guide dielectric segment, thereby preventing longitudinal movement of the split dielectric segment within the connector shell, which in turn prevented movement of the contacts along the length of the connector.

However, previously proposed connector designs have met with limited success. The interlocking features formed within the split dielectric segment and on the contacts require that the dielectric be made of two pieces, namely with a lead guide dielectric segment to align the contacts and with a rear split dielectric segment to lock the contacts at a fixed longitudinal position within the contact shell. The connectors have very small overall size and are assembled in large quantities. Hence, the use of a multi-piece dielectric unduly complicated the manufacturing process.

Further, previously proposed connectors have been unable to satisfactorily maintain the contacts in a desired geometry within the connector, as well as resist movement of the contacts along the longitudinal axis of the connector.

A need remains for an improved axial connector that may be easily and reliably manufactured with few components and that provides wire management and contact positioning and orientation.

BRIEF SUMMARY OF THE INVENTION

The present invention generally relates to a connector for conveying high-speed data signals, and more specifically to an axial connector having a dielectric member that securely positions and orients the contacts in a desired geometry within the connector. The dielectric member has a deflectable portion that securely retains contacts at a fixed longitudinal position along the connector.

Figure 1:
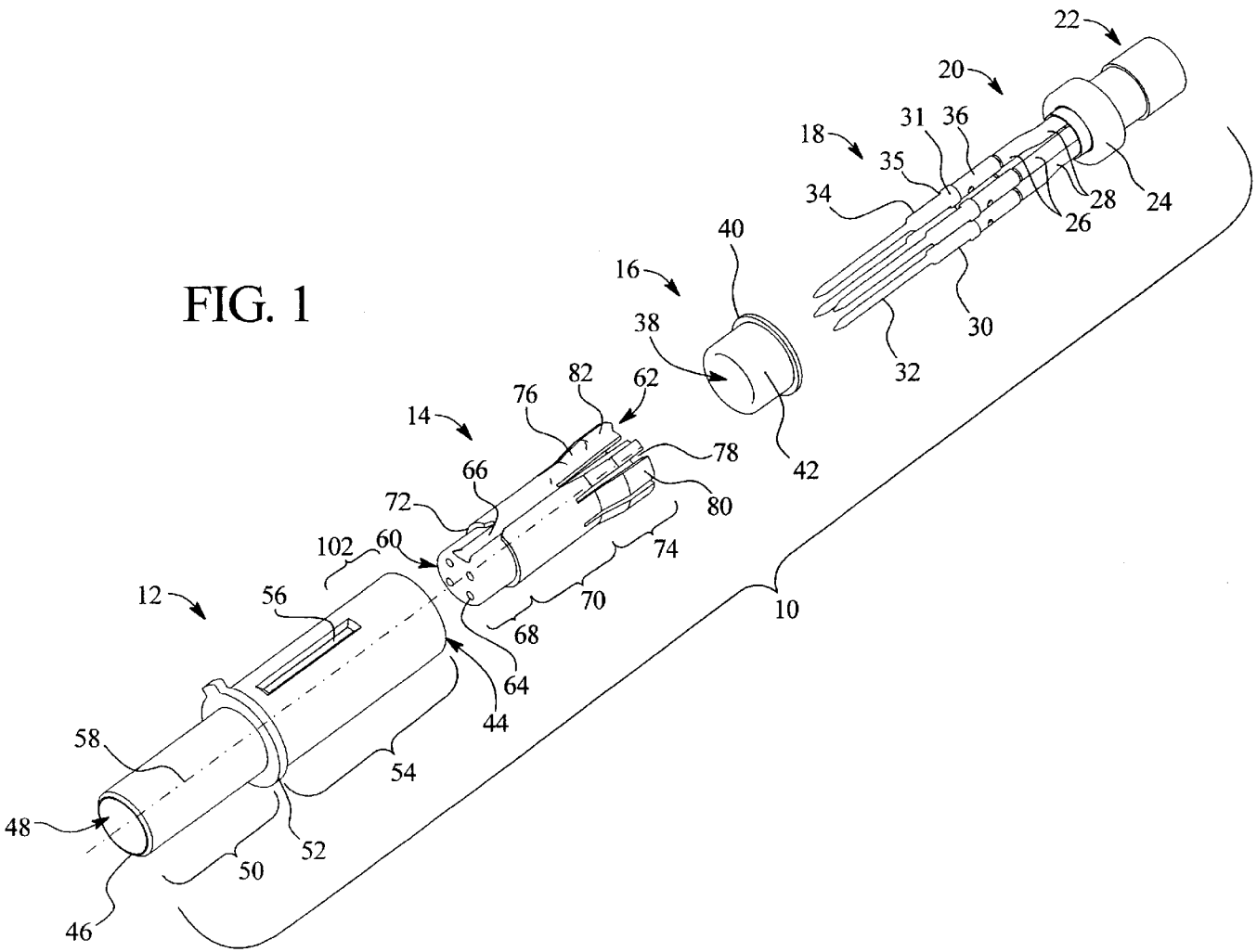
FIG. 1 illustrates an exploded isometric view of a connector assembly formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an exploded isometric view of a connector assembly 10 formed in accordance with an embodiment of the present invention. The connector assembly 10 includes an outer shell 12 that receives therein a dielectric member 14 and a ferrule 16. A plurality of contacts 18 are mounted to corresponding signal wires 20 and inserted through the ferrule 16 into the dielectric member 14. The signal wires 20 are held within a cable 22. An outer braid 24 is folded back upon the cable 22 to expose the signal wires 20 (each of which is individually insulated).

In certain applications, the signal wires 20 may be grouped into differential pairs and arranged in a particular geometry, such as a quadrature arrangement with a transmit pair 26 and a receive pair 28 as in the example of FIG. 1. Alternatively, the number of signal wires 20 may be varied and the geometry thereof may be changed. By way of example only, the number of signal wires 20 may be varied to include two wires, three wires, eight wires and the like.

The contacts 18 are each formed with a body section 30 having a pin 32 extending from a lead end thereof. Each body section 30 has a larger diameter than the diameter of the corresponding pin 32 in order to define a shoulder 34 therebetween. The body section 30 includes a flared section 31 defining a second shoulder 35. Each shoulder 34 and 35 may be sloped or step-wise. Each body section 30 further includes a rear socket 36 formed thereon and extending opposite to the pin 32. The rear socket 36 is hollow and configured to receive the conductors of a corresponding signal wire 20. The rear sockets 36 may be affixed to corresponding signal wires 20 in a variety of manners, such as soldering, crimping and the like. As a further option, the overall configuration and shape of the contacts 18 may be varied and need not include pins 32. Instead, the contacts may include blade portions, or any other well-known contact shape.

The ferrule 16 includes an opening 38 therethrough and a rim 40 at the rear end of the ferrule 16. The ferrule 16 is inserted over the contacts 18 until resting upon the cable 22. The ferrule 16 includes an exterior wall 42 that is dimensioned to be received within braid 24 and to sandwich the braid 24 between the ferrule 16 and the outer shell 12 with the rim 40 proximate a loading end 44 of the outer shell 12.

The outer shell 12 is generally tubular in shape and is formed with a mating end 46 configured to be joined with a corresponding connector assembly (such as a socket connector assembly as discussed below). The outer shell 12 includes a cavity 48 extending therethrough between the loading and mating ends 44 and 46. The outer shell 12 includes a lead portion 50 dimensioned to be received within a mating connector assembly. A rim 52 is provided at an interface between the lead portion 50 and a body portion 54. The body portion 54 includes an indentation formed along the length of the body portion 54, thereby defining a keying feature 56 that projects into the cavity 48. The keying feature 56 extends in a direction parallel to a longitudinal axis 58 of the connector assembly 10 (also referred to as the center line of the outer shell 12).

The dielectric member 14 may be a unitary structure formed from a single piece of insulative material. The dielectric member 14 includes front and rear ends 60 and 62 oriented along the longitudinal axis 58. A plurality of contact passages 64 are formed within the dielectric member 14 and extend between the front and rear ends 60 and 62. The contact passages 64 are formed in a predefined geometry relative to the longitudinal axis 58 of the connector assembly 10 based on the particular application and geometry of the cable 22. A keying notch 66 is formed in the exterior of the dielectric member 14 and extends rearward from the front end 60. The keying notch 66 is shaped to align with the keying feature 56 projecting into the cavity 48. The dielectric member 14 includes a lead section 68 having a smaller diameter than an intermediate body section 70. The lead section 68 extends into the lead portion of the cavity 48 within the lead portion 50 of the outer shell 12. A rim 72 is formed on the dielectric member 14 at the interface between the lead and body sections 68 and 70, which locates the dielectric member 14 at a predetermined depth within the outer shell 12 from the mating end 46 along the longitudinal axis 58. The dielectric member 14 also includes a flared section 74 (also referred to as a contact gripping section) formed proximate the rear end 62. The flared section 74 has an outer envelope with a larger diameter proximate the rear end 62 than the diameter of the body section 70. In the example of FIG. 1, a ramped surface 76 forms a lead-in transition area between the body and flared sections 70 and 74. Optionally, the ramped surface 76 may be formed in a stepwise manner to afford a more sharp transition, or may be more gradually sloped up to the rear end 62. As a further option, the flared section 74 may have the same diameter throughout (or even a lesser diameter throughout) than the diameter of the body section 70.

The dielectric member 14 further includes a plurality of collets 78 cut or formed therein and extending from the rear end 62 forward in a direction parallel to the longitudinal axis 58. Optionally, the collets 78 may be cut or formed in a pie or spiral pattern with respect to the longitudinal axis 58, and extending along the dielectric member 14. The collets 78 in the example of FIG. 1 are evenly distributed about the perimeter of the dielectric member 14. Alternatively, the collets 78 need not be distributed about the entire perimeter, but instead may be grouped unevenly on selected sides of the dielectric member 14. In the example of FIG. 1, the collets 78 extend through the flared section 74 into the body section 70. Alternatively, the collets 78 may terminate within the flared section 74 or may extend entirely or substantially through the body section 70.

The collets 78 define a plurality of legs 80 that are clustered about, and extend parallel to, the longitudinal axis 58. Each leg 80 includes a the ramped surface 78 which joins a crimping surface 82. The legs 80 are deflectable and configured to be compressed to collapse inward radially toward the longitudinal axis 58. As explained below in more detail, the legs 80, when collapsed, compressably and frictionally grip the signal wires 20 to retain the contacts 18 at a particular depth relative to the mating end 46 of the outer shell 12 along the longitudinal axis 58. Optionally, the legs 80 may be positioned and configured to directly grip and frictionally engage the body sections 30 or rear sockets 36 of the contacts 18. When collapsed, the contact passages 64 retain the pins 32 in a predefined pattern or geometry with respect to the longitudinal axis 58.

Figure 2:
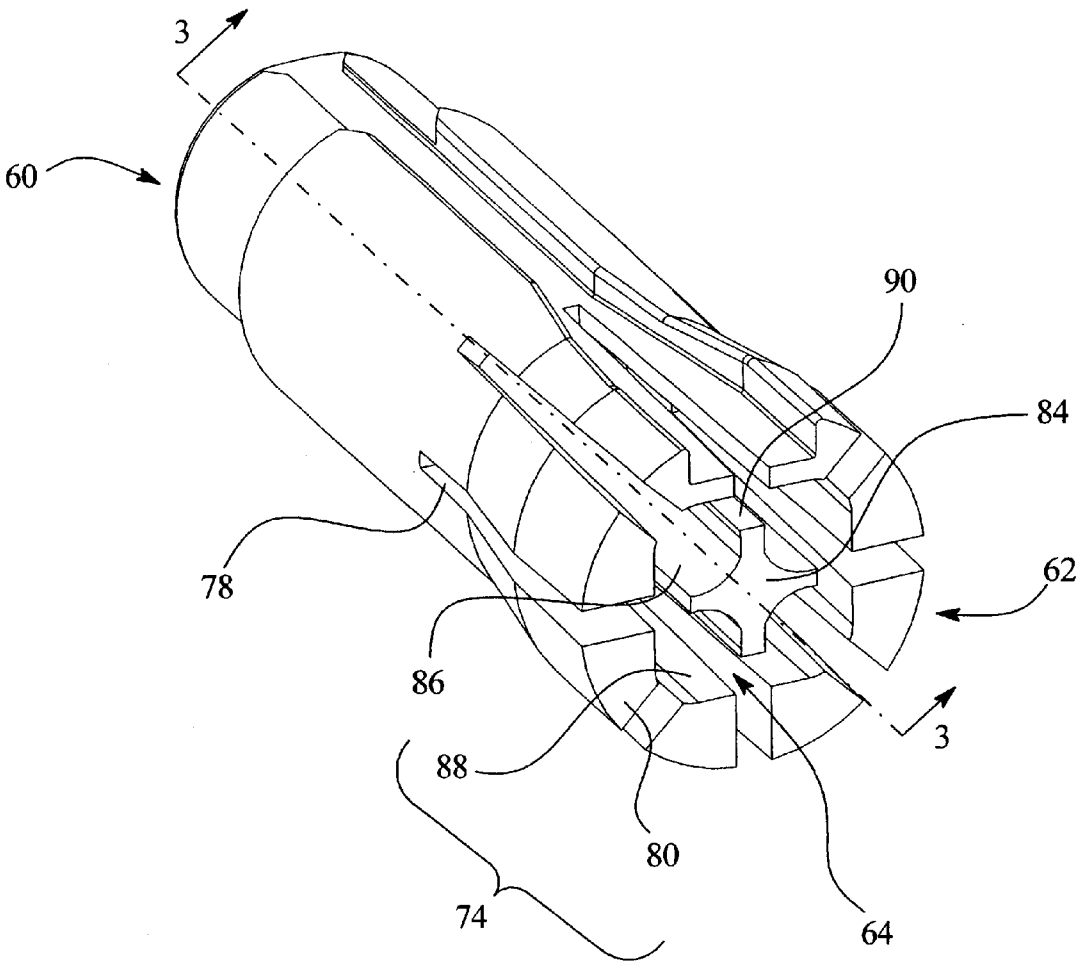
FIG. 2 illustrates an end isometric view of a dielectric member formed in accordance with an embodiment of the present invention.

FIG. 2 illustrates an end isometric view of the dielectric member 14 with the rear end 62 visible. In the example of FIG. 2, each contact passage 64 is surrounded and defined by a pair of legs 80 and a dielectric core 84. The dielectric core 84 has a series of radiused surfaces 86 notched in its exterior and about its perimeter. Each radiused surface 86 extends along the length of the dielectric member 14 to define one side of a corresponding contact passage 64. Interior surfaces 88 of each leg 80 are similarly radiused or curved such that when a corresponding pair of legs 80 are compressed inward radially toward the dielectric core 84, interior surfaces 88 of adjacent legs 80 are positioned substantially adjacent (and may abut against) one another to define a curved wall of the corresponding contact passage 64. The dielectric core 84 separates adjacent radiused surfaces 86 with ledges 90 facing outward. The ledges 90 may be and positioned to abut against the interior surfaces 88 of the legs 80, in order to prevent the flared section 74 from being unduly collapsed until destructably compressing the signal wires 20 and/or contacts 18. Optionally, the interior surfaces 88 and ledges 90 may be dimensioned to avoid one another in embodiments in which it is desirable to permit the legs 80 to be compressed inward by an unlimited amount.

Figure 3:
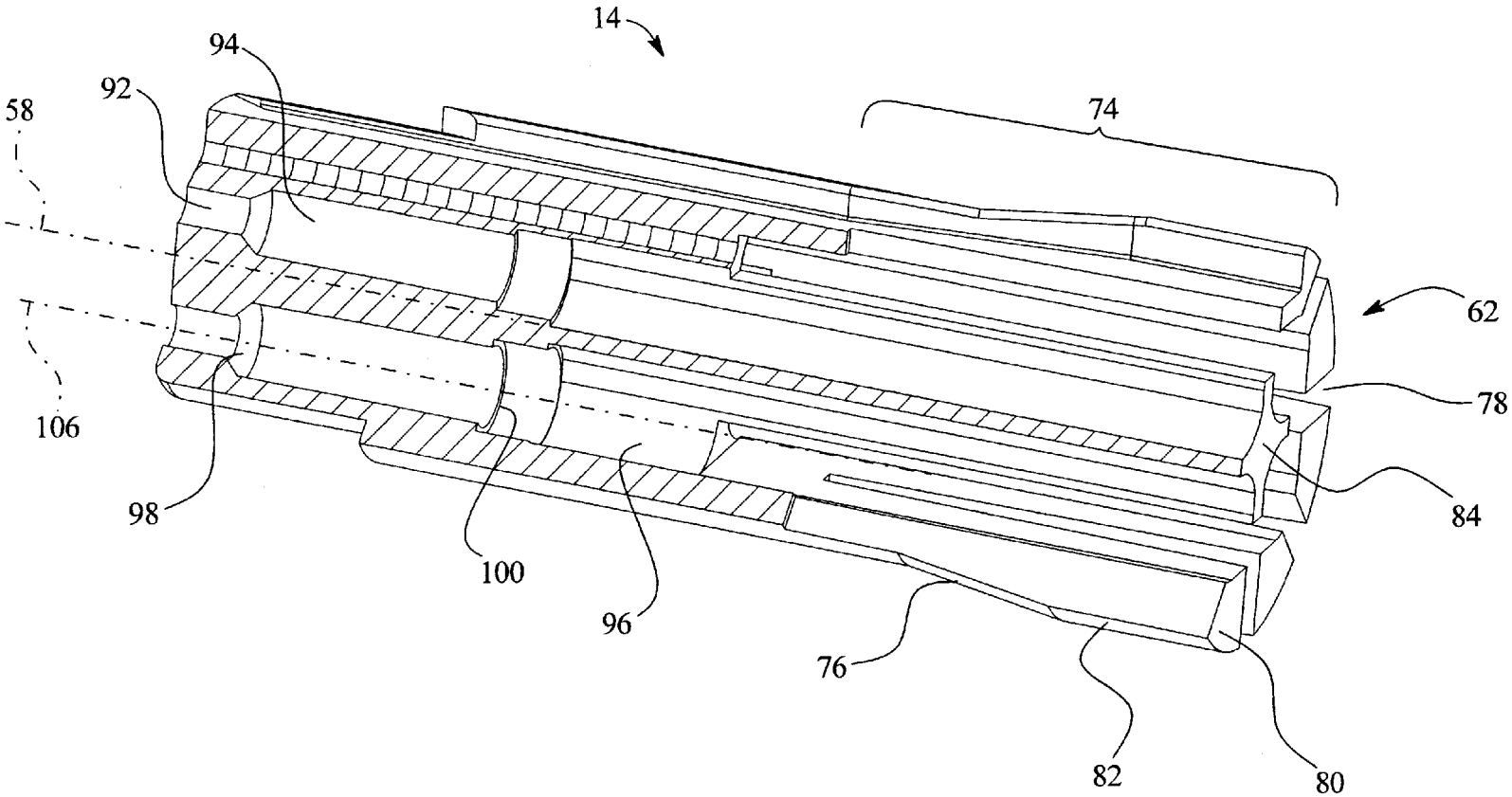
FIG. 3 illustrates a side sectional view of a dielectric member taken along line 3—3 in FIG. 2.

FIG. 3 illustrates a side sectional view taken along line 3—3 in FIG. 2 of the dielectric member 14. As illustrated in more detail in FIG. 3, the contact passages 64 are formed with a stepwise diameter to define lead, intermediate and rear portions 92, 94 and 96, respectively. The lead portions 92 have a smaller diameter than the intermediate portions 94 which in turn have a smaller diameter than the rear portions 96. Shelves 98 and 100 are formed at the points of intersection between the lead and intermediate portions 92 and 94, and between the intermediate and rear portions 94 and 96, respectively.

With reference to FIGS. 1 and 3, the contacts 18 are inserted into the contact passages 64 until the shoulders 35 at the flared portion 31 on each contact 18 engage a corresponding shelf 100 within the contact passages 64. The shelves 100 and shoulders 35 cooperate to locate each contact 18 at a predefined point along the length of the longitudinal axis 58 (FIG. 1) with respect to the mating end 44 of the connector assembly 10. Optionally, the shoulder 34 on each contact 18 may also engage a corresponding shelf 98.

Figure 4:
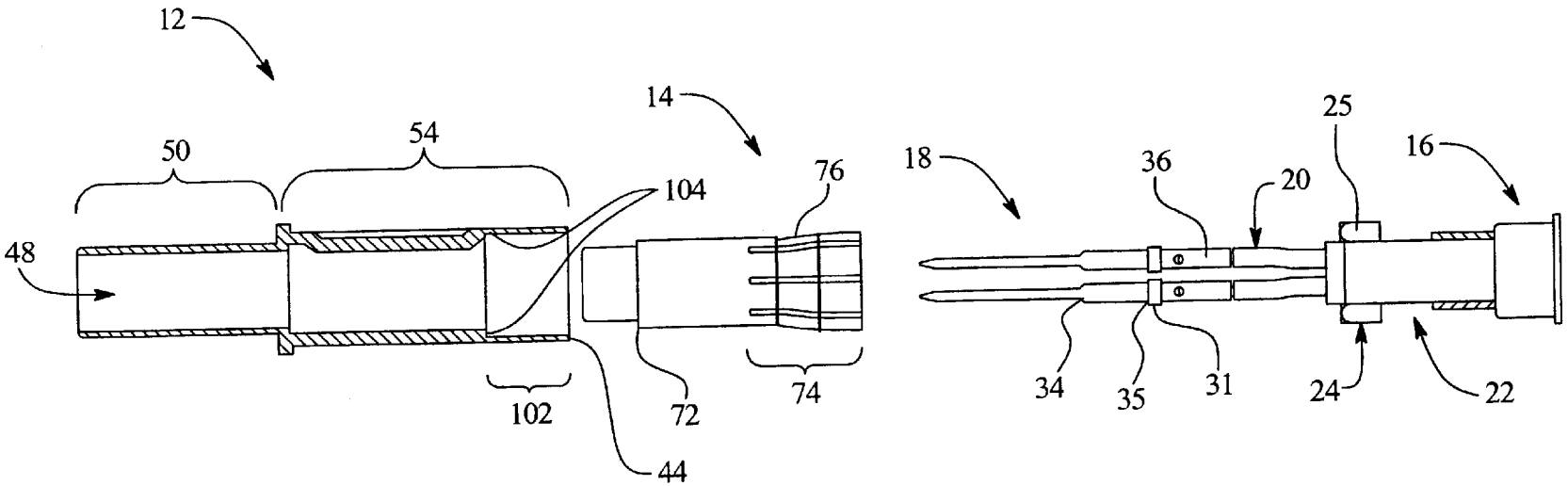
FIG. 4 illustrates a side view of a disassembled connector assembly and cable in accordance with an embodiment of the present invention.

FIG. 4 illustrates an exemplary cross-section of the outer shell 12. The outer shell 12 is constructed with an O-crimp section 102 formed proximate the loading end 44. The O-crimp section 102 represents a ring having a larger interior diameter than an interior ring of the body portion 54 to define a ledge 104 therebetween. The ledge 104 is configured to engage the ramped surfaces 76 on each of the legs 80 to collapse the collets 78.

Next, FIGS. 4–8 are referenced to explain an exemplary order of operations through which the connector assembly 10 is connected to the cable 22. The outer insulator on the end of the cable 22 is stripped and the braid 24 is dressed back over the outer insulator to expose a portion of the signal wires 20. Ends of the signal wires 20 are stripped of insulation and secured within the rear sockets 36 of corresponding contacts 18. (FIG. 4) The ferrule 16 may be slid over the cable 22 before or after stripping the insulation and before dressing back the braid 24.

Figure 5:
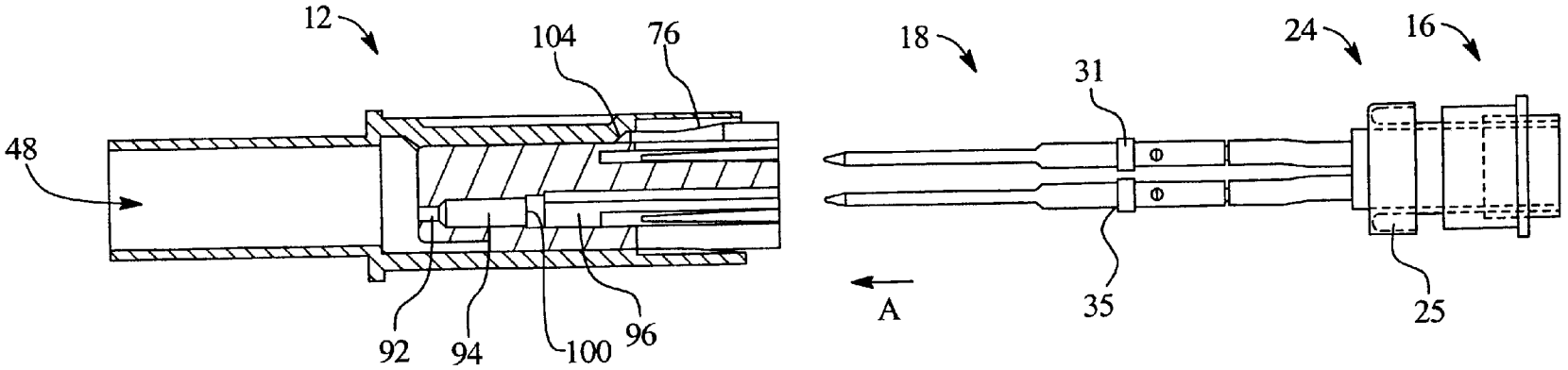
FIG. 5 illustrates a partially assembled connector assembly and cable in accordance with an embodiment of the present invention.
Figure 6:
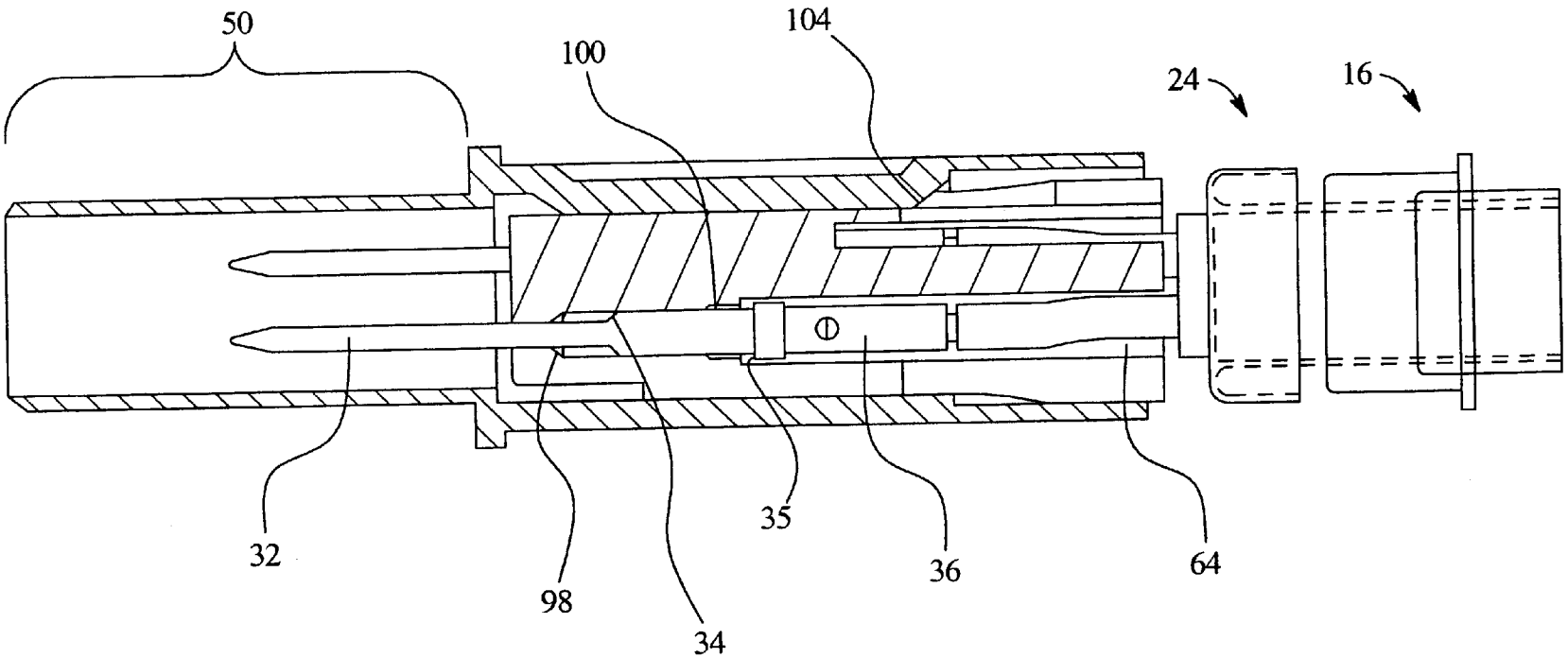
FIG. 6 illustrates a side sectional view of a connector assembly and partially loaded cable formed in accordance with an embodiment of the present invention.
Figure 7:
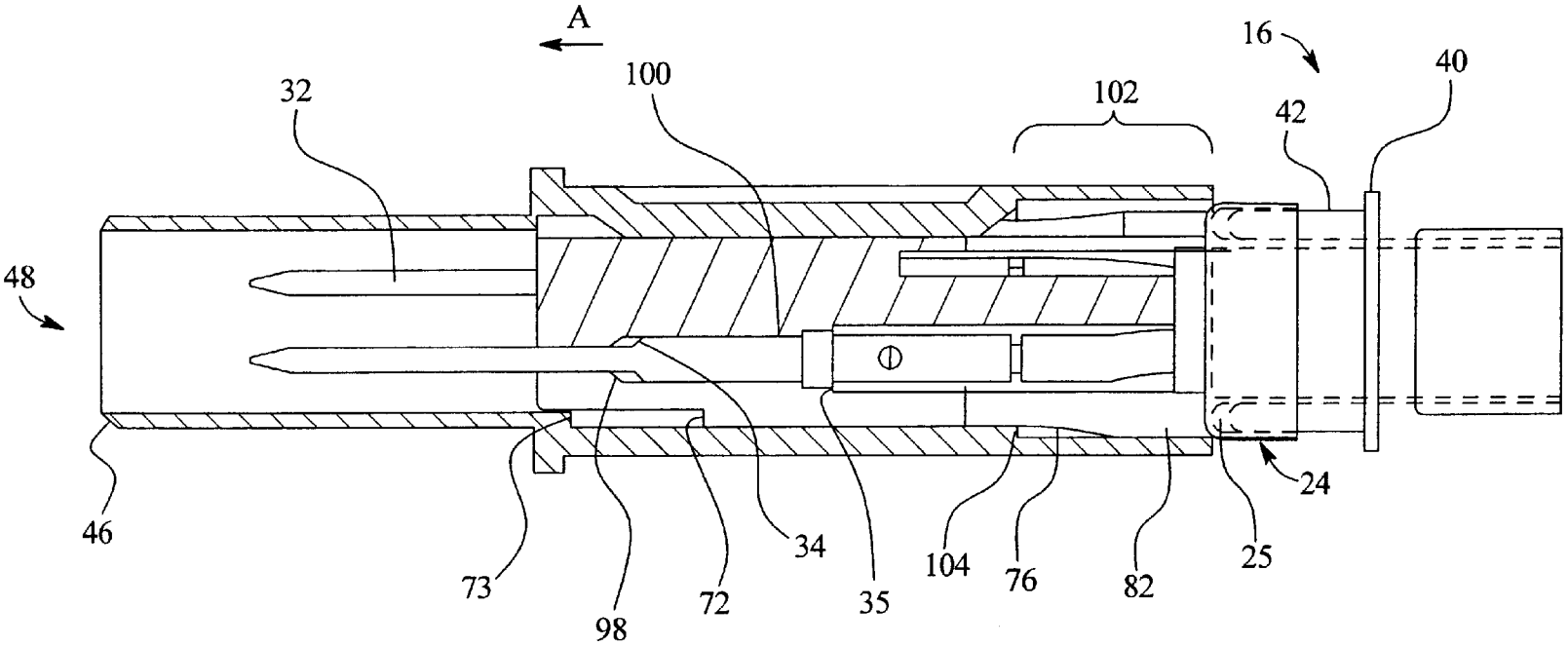
FIG. 7 illustrates a side sectional view of a connector assembly partially loaded with a cable in accordance with an embodiment of the present invention.

As shown in FIG. 5, the dielectric member 14 may be inserted into the outer shell 12 before the contacts 18 are inserted into the dielectric member 14. Optionally, the contacts 18 may be first inserted into the dielectric member 14 which is then inserted into the outer shell 12. As shown in FIG. 6, the contacts 18 are loaded into the contact passages 64 until the pins 32 are received within the lead portion 50 of the outer shell 12. As shown in FIG. 7, contacts 18 are further loaded in passages 64 until fully seated relative to dielectric member 14 with shoulders 34 and 35 abutting against ledges 98 and 100, respectively. With reference to FIG. 7, the ferrule 16 is slid forward in the direction of arrow A until the exterior wall 42 is received within the interior pocket 25 of the braid 24. The ferrule 16 is pressed forward in the direction of arrow A relative to the outer shell 12, thereby further engaging dielectric 14, and therein fully loaded contacts 18, within outer shell 12.

Figure 8:
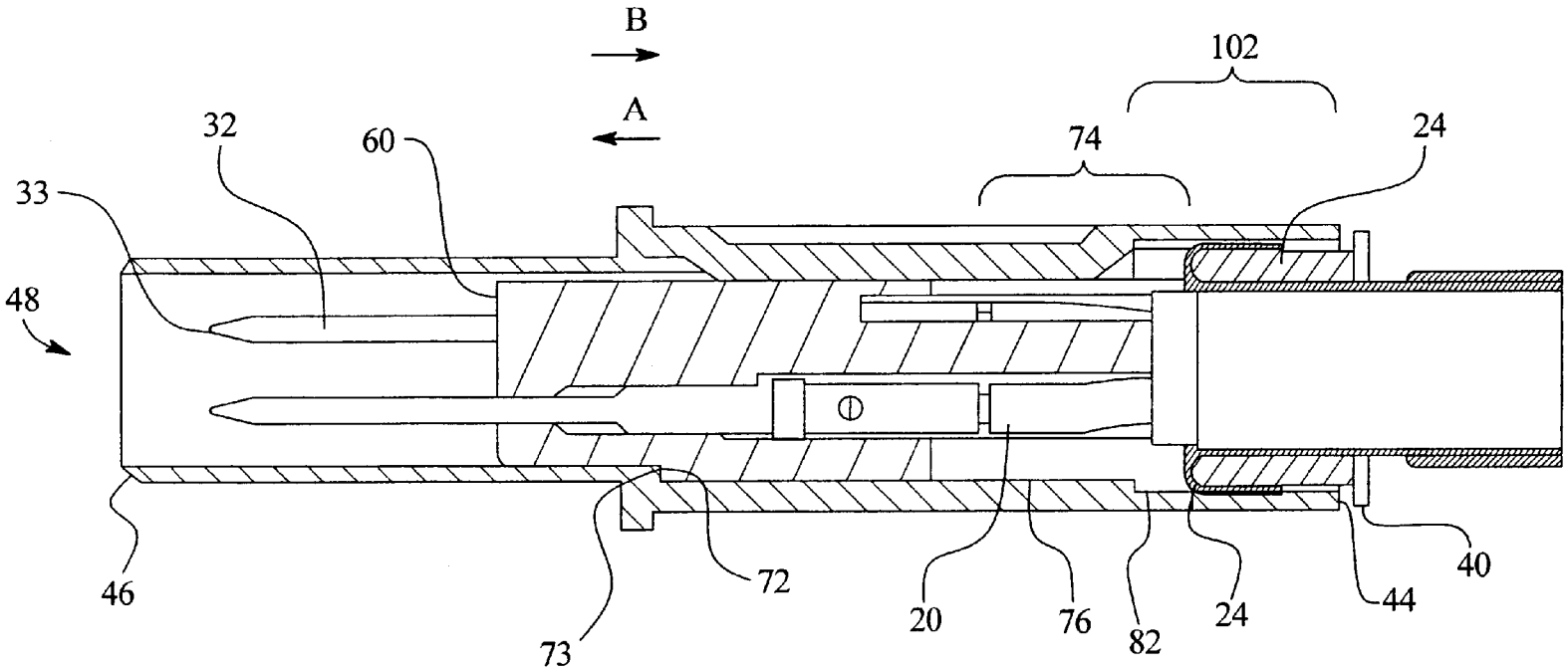
FIG. 8 illustrates a side sectional view of a connector assembly and fully loaded cable in accordance with an embodiment of the present invention.

As shown in FIG. 8, the ferrule 16 is further slid forward in the direction of arrow A with respect to the outer shell 12 until the ferrule 16 is seated within the O-crimp section 102 of the outer shell 12. Optionally, the rim 40 may be slid forward until proximate or abutting against the loading end 44 of the outer shell 12. By pressing the ferrule 16 forward in this manner, pressure is also applied to the dielectric member 14 which causes the ramped surfaces 76 on each leg 80 to be deflected radially inward by the ledge 104. As the ledge 104 compresses the legs 80 inward, the interior surfaces 88 of each ledge 80 compressively and frictionally engage the signal wires 20 (and/or contacts 18) within corresponding contact passages 64. The dielectric member 14 is pushed forward until the rim 72 on the dielectric member 14 seats against a ledge 73 in the cavity 48 to locate the front end 60 a defined depth from the mating end 46 of the outer shell 12. The tips 33 of pins 32 are also a fixed distance from the front end 60, which ensures that the pins 32 are at a known location within the outer shell 12. The flared section 74 and ferrule 24, when crimped by O-crimp section 102 firmly grip the signal wires 20 to resist movement in the direction of arrow B.

Figure 9:
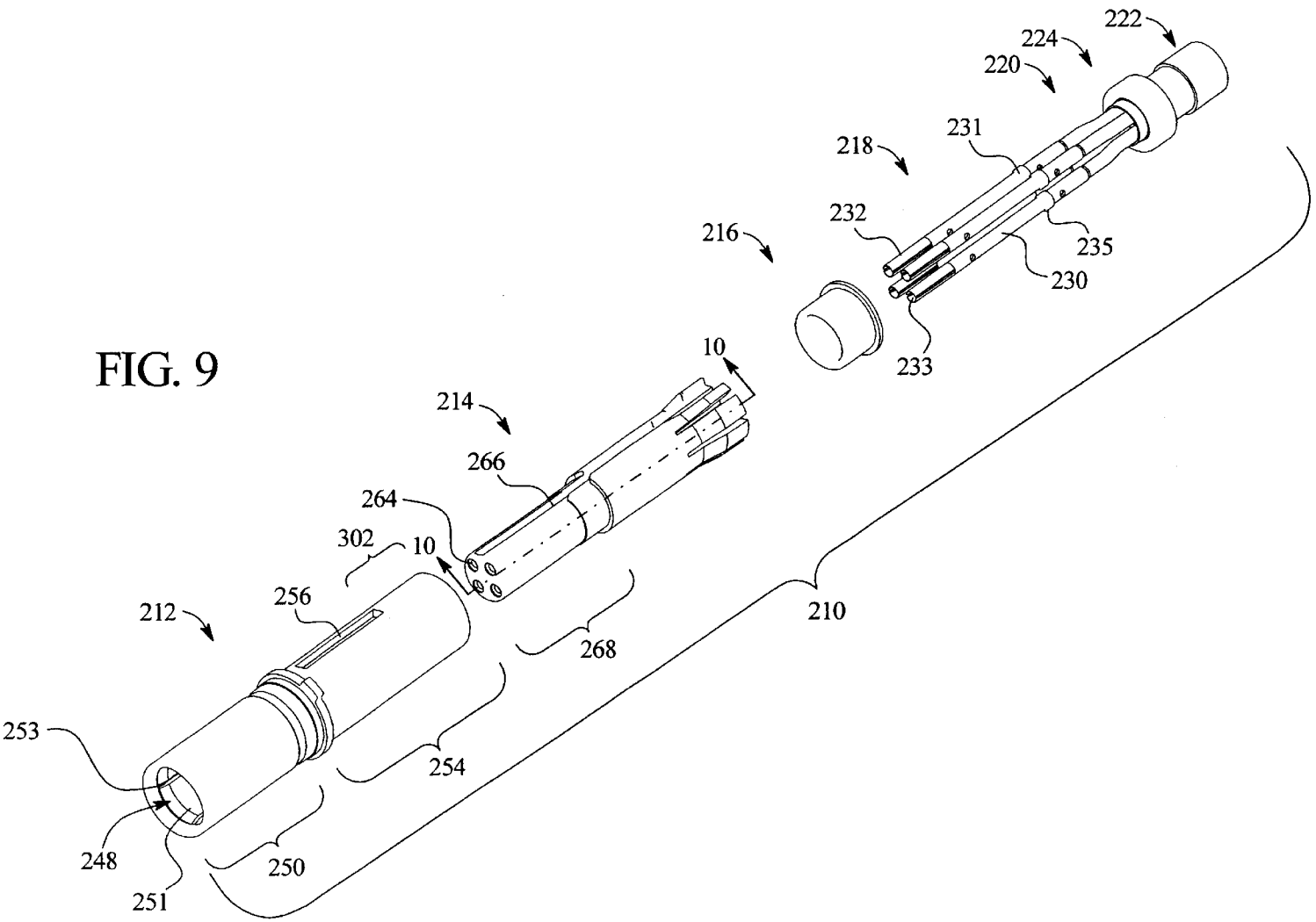
FIG. 9 illustrates an exploded isometric view of a socket connector assembly formed in accordance with an embodiment of the present invention.

FIG. 9 illustrates a socket connector assembly 210 configured to mate with the connector assembly 10 of FIG. 1. The socket connector assembly 210 includes an outer shell 212, a dielectric member 214, a ferrule 216, socket contacts 218, signal wires 220 and a cable 222, aligned along a longitudinal axis 258. The foregoing structure is designed to interconnect in a manner similar to that explained above in connection with the connector assembly 10 of FIG. 1. The socket contacts 218 are configured slightly different from contacts 18 in that the body sections 230 include socket sections 232 on lead ends thereof having pin receptacles 233 formed therein. The pin receptacles 233 are configured to receive and form an electrical connection with the pins 32 when contacts 18 and 218 are joined. The dielectric member 214 is configured with a lead section 268 slightly longer than the lead section 68 of the connector assembly 10. The pins 32 on contacts 18 (FIG. 1) are received within contact passages 264 of the dielectric member 214 such that the connection between pins 32 and socket sections 232 is formed within the lead section 268. The dielectric member 214 includes a keying notch 266 formed therein and configured to align with a keying feature 256 projecting into the interior of the cavity 248 in outer shell 212. The outer shells 12 and 212 also include keying features to insure a particular alignment therebetween when mated, in order that particular contacts 18 are adjoined with an associated socket contact 218.

The outer shell 212 further includes a lead portion 250 configured to receive the lead portion 50 of connector assembly 10. The lead portion 250 includes, within the cavity 248, a plurality of compliant body segments 251 separated by slots 253 that are biased radially inward. The body segments 251 firmly engage the exterior of the lead portion 50, thereby insuring a firm connection therebetween. The outer shells 12 and 212 may be conductive to afford a grounded shield surrounding the contacts 18 and 218. Optionally, the outer shells 12 and 212 may have an insulated exterior.

Figure 10:
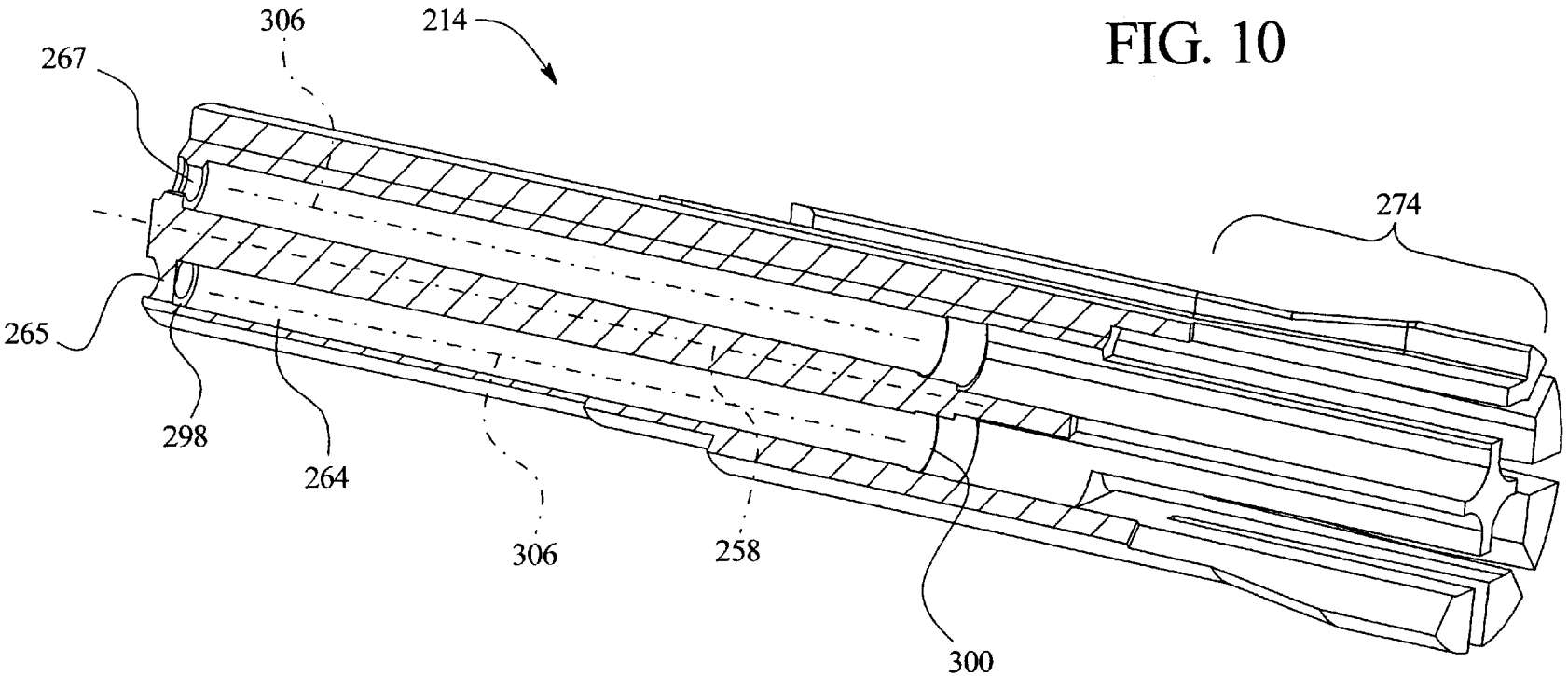
FIG. 10 illustrates a side sectional view taken along line 10—10 in FIG. 9 of a dielectric member formed in accordance with an embodiment of the present invention.

FIG. 10 illustrates a side sectional view taken along line 10—10 in FIG. 9 of the dielectric member 214. The dielectric member 214 includes contact passages 264 that may have a step-wise radius to form a shelf 300. The shelf 300 is configured to abut against and engage a shoulder 235 (FIG. 9) at a flared portion 231 on a corresponding contact 218 to insure proper alignment along the longitudinal axis 258 of the socket contacts 218 with respect to the socket connector assembly 210 (FIG. 9) and dielectric member 214

(FIG. 10). The contact passage 264 further includes a front wall 265 having an opening 267 therethrough. The wall 264 forms a shelf 298 against which the lead end of the socket section 232 of each socket contact 218 may abut.

When the connector assembly 10 is fully mated with the socket connector assembly 210, corresponding contact passages 64 and 264 are aligned with one another, such that center lines 106 (FIG. 3) of contact passages 64 coincide with center lines 306 (FIG. 10) of contact passages 264. Once the flared sections 74 (FIG. 2) and 274 (FIG. 10) are collapsed, the corresponding signal wires 20 and 220 (or contacts 18 and 218, respectively) are held in a particular orientation and alignment along the center lines 106 and 306 with respect to the longitudinal axes 58 and 258, respectively. Hence, the connector assembly 10 and socket connector assembly 210 achieve the desired wire management and positioning and orientation of the contacts 18 and 218 and wires 20 and 220, both radially and longitudinally with respect to the longitudinal axes 58 and 258.

O-crimp sections 102 and 302 on the outer shells 12 and 212, respectively, further compress the flared sections 74 and 274 and ferrules 16 and 216, respectively.

Optionally, the dielectric member 14 may be formed with slots cut in the sides of the flared section 74 to permit the lead in portions of the contacts to be side loaded before being inserted into the body and lead sections 68 and 70 of the dielectric member 14. When such slots are used, optionally, only a pair of collets may be cut in opposite sides of the flared section 74.

Optionally, the outer shell need not be crimped onto the flared sections 74 and 274. Instead, the flared sections 74 and 274 may be collapsed in other manners so long as the gripping force is sufficient to maintain the contacts in a stable and unmovable position with respect to each outer shell. By preventing rearward movement of the contacts when experiencing mating forces along the length of the contacts, the connector assemblies insure that the contacts (pin and receptacle) are fully joined when the outer shells are fully joined.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector, comprising:

a grounded outer shell having a cavity formed therein, said cavity extending between a loading end and a mating end of said outer shell, said mating end being configured to join with a mating connector; and a unitary dielectric member inserted into said cavity in said outer shell, said dielectric member having contact passages formed therein and extending between front and rear ends of said dielectric member, said contact passages being configured to receive contacts, said dielectric member having a flared section located proximate said rear end, said flared section including collets extending partially along a length of said dielectric member, said collets permitting said flared section to collapse onto said contact passages, when collapsed, said flared section being configured to positively and firmly grasp contacts inserted into said contact passages.

2. The electrical connector of claim 1, further comprising a ferrule received in said outer shell proximate said rear end of said dielectric member, said ferrule being configured to surround and firmly grip a cable.

3. The electrical connector of claim 1, wherein said outer shell includes an O-crimp section formed therein proximate said loading end of said outer shell, said O-crimp section being collapsed about a perimeter of said outer shell to cause said dielectric member to firmly grip a cable therein.

4. The electrical connector of claim 1, wherein said cavity in said outer shell includes a stepwise interior wall defined a ledge between rings of different diameter, said ledge engaging said flared section of said dielectric member to partially collapse said flared section.

5. The electrical connector of claim 1, wherein said flared section of said dielectric member includes legs separated by said collets, said legs extending toward said rear end, each of said legs being deflected radially inward toward a corresponding one of said contact passages to firmly grip contacts provided in said contact passages.

6. The electrical connector of claim 1, wherein said dielectic member has a body section proximate said flared section, said flared section having an outer envelope with a larger diameter proximate said rear end than a diameter of body section.

7. The electrical connector of claim 1, wherein said contact passages extend along contact center lines located in a predefined geometry with respect to a longitudinal axis into said outer shell, said dialectic member being configured to maintain contacts loaded into contact passages through said rear end of said dielectric member in said predefined geometry with respect to said longitudinal axis.

8. The electrical connector of claim 1, wherein said contacts are loaded into said contact passages through said rear end of said dielectric member until reaching a predefined depth within said contact passages with respect to said mating end, said flared section gripping said contacts when collapsed to resist movement of said contacts along said contact passages.

9. The electrical connector of claim 1, wherein said collets separate said flared section into individual legs that flare outward from, extend along and partially define walls of, said contact passages, said legs being deflected toward a longitudinal axis of said dielectric member to partially collapse said contact passages.

10. The electrical connector of claim 1, wherein said dielectric member is loaded through said loading end of said outer shell into said cavity until said rear end of said dielectric member is located proximate said loading end of said outer shell.

11. An electrical connector assembly, comprising:

a cable with contacts secured to cable connectors;

a shell with a cavity therein, said cavity extending through said shell; and a dielectric member loaded into said cavity, said dielectric member having contact passages extending through said dielectric member between front and rear ends of said dielectric member, said contacts being loaded into said contact passages through said rear end of said dielectric member, said dielectric member having collets extending from said rear end partially along a length of said dielectric member to define a gripping section of said dielectric member, said gripping section being flared outward and collapsed to frictionally engage at least one of said contacts and cable conductors.

12. The electrical connector assembly of claim 11, further comprising a ferrule received in said shell and abutting said rear end of said dielectric member, wherein a portion of said shell is crimped to collapse said ferrule and said gripping section of said dielectric member to firmly grip said cable.

13. The electrical connector assembly of claim 11, wherein said shell includes an O-crimp section formed therein proximate a rear end of said shell, said dielectric member being loaded through said O-crimp section, said O-crimp section being crimped to compress said gripping section of said dielectric member.

14. The electrical connector assembly of claim 11, wherein said cavity in said shell includes a stepwise interior wall defining a ledge, said ledge compressing said gripping section to frictionally engage at least one of said contacts and cable conductors.

15. The electrical connector assembly of claim 11, wherein said gripping section includes legs separated by said collets, said legs extending toward said rear end, each of said legs being deflectable radially inward toward a corresponding one of said contact passages to firmly grip said contacts provided in said contact passages.

16. The electrical connector assembly of claim 11 wherein said dielectric member has a body section proximate said gripping section, said dielectric member having an outer envelope with a longer diameter proximate said gripping section than a diameter of said body section.

17. The electrical connector assembly of claim 11, wherein said contact passages extend along contact center lines located in a predefined geometry with respect to a longitudinal axis of said shell, said dielectric member being configured to maintain said contacts loaded in said contact passages in said predefined geometry with respect to said longitudinal axis.

18. The electrical connector assembly of claim 11, wherein said contact passages include internal ledges that cooperate with corresponding ridges provided on said contacts to define a maximum depth to which said contacts are loaded into said contact passages with respect to said front end of said dielectric member.

19. The electrical connector assembly of claim 11, wherein said collets separate said gripping section into individual legs that flare outward from, extend along, and partially define walls of, said contact passages, said legs being deflected toward a longitudinal axis of said dielectric member to partially collapse into said contact passages.

20. The electrical connector assembly of claim 11, wherein said collets intersect and extend along a rear portion of said contact passages.

* * * * *

UNITED STATES PATENT AND TRADEMARK OFFICE

CERTIFICATE OF CORRECTION

PATENT NO. : 6,669,502 B1
APPLICATION NO. : 10/247097
DATED : December 30, 2003
INVENTOR(S) : Yohn Bernhart It is certified that error appears in the above-identified patent and that said Letters Patent is hereby corrected as shown below:

IN THE CLAIMS

Col. 7 line 53-67 should read,

1. An electrical connector, comprising:

a grounded outer shell having a cavity formed therein, said cavity extending between a loading end and a mating end of said outer shell, said mating end being configured to join with a mating connector; and a unitary dielectric member inserted into said cavity with a front end and a rear end of said unitary dielectric member being located proximate said mating end and said loading ends, respectively, of said outer shell, said dielectric member having contact passages formed therein and extending between said front and rear ends of said dielectric member, said contact passages being configured to receive contacts from said rear end, said dielectric member having a flared section located proximate said rear end, said flared section including collets extending partially along a length of said dielectric member, said collets permitting said flared section to collapse onto said contact passages, when collapsed, said flared section being configured to positively and firmly grasp contacts inserted into said contact passages.

UNITED STATES PATENT AND TRADEMARK OFFICE

CERTIFICATE OF CORRECTION

PATENT NO. : 6,669,502 B1
APPLICATION NO. : 10/247097
DATED : December 30, 2003
INVENTOR(S) : Yohn Bernhart It is certified that error appears in the above-identified patent and that said Letters Patent is hereby corrected as shown below:

Col. 8 line 4-7 should read,

2. The electrical connector of claim 1, further comprising a ferrule received in said outer shell proximate said rear end of said dielectric member, said ferrule being configured to surround and firmly grip a cable.

Col. 8 line 8-12 should read

3. The electrical connector of claim 1, wherein said outer shell includes an O-crimp section formed therein proximate said loading end of said outer shell, said O-crimp section being collapsed about a perimeter of said outer shell to cause said dielectric member to firmly grip a cable therein.

Col. 8 lines 12-16 should read,

4. The electrical connector of claim 1, wherein said cavity in said outer shell includes a stepwise interior wall defined a ledge between rings of different diameter, said ledge engaging said flared section of said dielectric member to partially collapse said flared section.

Col. 8 lines 17-22 should read,

5. The electrical connector of claim 1, wherein said flared section of said dielectric member includes legs separated by said collets, said legs extending toward said rear end, each of said legs being deflected radially inward toward a corresponding one of said contact passages to firmly grip contacts provided in said contact passages.

UNITED STATES PATENT AND TRADEMARK OFFICE

CERTIFICATE OF CORRECTION

PATENT NO. : 6,669,502 B1
APPLICATION NO. : 10/247097
DATED : December 30, 2003
INVENTOR(S) : Yohn Bernhart It is certified that error appears in the above-identified patent and that said Letters Patent is hereby corrected as shown below:

Col. 8 lines 23-27 should read,

6. The electrical connector of claim 1, wherein said dielectic member has a body section proximate said flared section, said flared section having an outer envelope with a larger diameter proximate said rear end than a diameter of body section.

Col. 8 lines 27-33 should read,

7. The electrical connector of claim 1, wherein said contact passages extend along contact center lines located in a predefined geometry with respect to a longitudinal axis into said outer shell, said dialectic member being configured to maintain contacts loaded into contact passages through said rear end of said dielectric member in said predefined geometry with respect to said longitudinal axis.

Col. 8 lines 34-40 should read,

8. The electrical connector of claim 1, wherein said contacts are loaded into said contact passages through said rear end of said dielectric member until reaching a predefined depth within said contact passages with respect to said mating end, said flared section gripping said contacts when collapsed to resist movement of said contacts along said contact passages.

UNITED STATES PATENT AND TRADEMARK OFFICE

CERTIFICATE OF CORRECTION

PATENT NO. : 6,669,502 B1
APPLICATION NO. : 10/247097
DATED : December 30, 2003
INVENTOR(S) : Yohn Bernhart It is certified that error appears in the above-identified patent and that said Letters Patent is hereby corrected as shown below:

Col. 8 lines 41-46 should read

9. The electrical connector of claim 1, wherein said collets separate said flared section into individual legs that flare outward from, extend along and partially define walls of, said contact passages, said legs being deflected toward a longitudinal axis of said dielectric member to partially collapse said contact passages.

Col. 8 lines 47-50 should read

10. The electrical connector of claim 1, wherein said member is loaded through said loading end of said outer shell into said cavity until said rear end of said dielectric member is located proximate said loading end of said outer shell.

UNITED STATES PATENT AND TRADEMARK OFFICE

CERTIFICATE OF CORRECTION

PATENT NO. : 6,669,502 B1
APPLICATION NO. : 10/247097
DATED : December 30, 2003
INVENTOR(S) : Yohn Bernhart It is certified that error appears in the above-identified patent and that said Letters Patent is hereby corrected as shown below:

Col. 8 lines 51-67 should read

11. An electrical connector assembly, comprising:

a cable with contacts secured to cable connectors;

a shell with a cavity therein, said cavity extending through said shell and having a mating end configured to join with a mating connector; and a dielectric member loaded into said cavity with a front end of said dielectric member being located proximate said mating end of said shell, said dielectric member having contact passages extending through said dielectric member between said front end and a rear end of said dielectric member, said contacts being loaded into said contact passages through said rear end of said dielectric member, said dielectric member having collets extending from said rear end partially along a length of said dielectric member to define a gripping section of said dielectric member, said gripping section being flared outward and collapsed to frictionally engage at least one of said contacts and cable conductors.

UNITED STATES PATENT AND TRADEMARK OFFICE

CERTIFICATE OF CORRECTION

PATENT NO. : 6,669,502 B1
APPLICATION NO. : 10/247097
DATED : December 30, 2003
INVENTOR(S) : Yohn Bernhart It is certified that error appears in the above-identified patent and that said Letters Patent is hereby corrected as shown below:

Col. 9 lines 1-5 should read

12. The electrical connector assembly of claim 11, further comprising a ferrule received in said shell and abutting said rear end of said dielectric member, wherein a portion of said shell is crimped to collapse said ferrule and said gripping section of said dielectric member to firmly grip said cable.

Col. 9 lines 6-11 should read

13. The electrical connector assembly of claim 11, wherein said shell includes an O-crimp section formed therein proximate a rear end of said shell, said dielectric member being loaded through said O-crimp section, said O-crimp section being crimped to compress said gripping section of said dielectric member.

Col. 9 lines 12-16 should read

14. The electrical connector assembly of claim 11, wherein said cavity in said shell includes a stepwise interior wall defining a ledge, said ledge compressing said gripping section to frictionally engage at least one of said contacts and cable conductors.

Col. 9 lines 17-22 should read

15. The electrical connector assembly of claim 11, wherein said gripping section includes legs separated by said collets, said legs extending toward said rear end, each of said legs being deflectable radially inward toward a corresponding one of said contact passages to firmly grip said contacts provided in said contact passages.

UNITED STATES PATENT AND TRADEMARK OFFICE

CERTIFICATE OF CORRECTION

PATENT NO. : 6,669,502 B1
APPLICATION NO. : 10/247097
DATED : December 30, 2003
INVENTOR(S) : Yohn Bernhart It is certified that error appears in the above-identified patent and that said Letters Patent is hereby corrected as shown below:

Col. 9 lines 23-25 should read

16. The electrical connector assembly of claim 11 wherein said dielectric member has a body section proximate said gripping section, said dielectric member having an outer envelope with a longer diameter proximate said gripping section than a diameter of said body section.

Col. 10 lines 3-9 should read

17. The electrical connector assembly of claim 11, wherein said contact passages extend along contact center lines located in a predefined geometry with respect to a longitudinal axis of said shell, said dielectric member being configured to maintain said contacts loaded in said contact passages in said predefined geometry with respect to said longitudinal axis.

Col. 10 lines 10-14 should read,

18. The electrical connector assembly of claim 11, wherein said contact passages include internal ledges that cooperate with corresponding ridges provided on said contacts to define a maximum depth to which said contacts are loaded into said contact passages with respect to said front end of said dielectric member.

UNITED STATES PATENT AND TRADEMARK OFFICE

CERTIFICATE OF CORRECTION

PATENT NO. : 6,669,502 B1 
APPLICATION NO. : 10/247097
DATED : December 30, 2004
INVENTOR(S) : Yohn Bernhart It is certified that error appears in the above-identified patent and that said Letters Patent is hereby corrected as shown below:

Col. 10 lines 15-20 should read, 19. (The electrical connector assembly of claim 11, wherein said collets separate said gripping section into individua1 legs that flare outward from, extend along, and partially define walls of, said contact passages, said legs being deflected toward a longitudinal axis of said dielectric member to partially collapse into said contact passages.

Col. 10 lines 21-23 should read,

20. The electrical connector assembly of claim 11, wherein said collets intersect and extend along a rear portion of said contact passages.

Signed and Sealed this

Seventeenth Day of October, 2006

JON W. DUDAS
*Director of the United States Patent and Trademark Office*